United States Patent [19]

De Nora et al.

[11] 4,162,953

[45] Jul. 31, 1979

[54] MONOPOLAR ELECTROLYTIC DIAPHRAGM CELLS WITH REMOVABLE AND REPLACEABLE DIMENSIONALLY STABLE ANODES AND METHOD OF INSERTING AND REMOVING SAID ANODES

[75] Inventors: Oronzio De Nora; Giuseppe Bianchi; Giovanni Meneghini, all of Milan, Italy

[73] Assignee: Oronzio de Nora Impianti Elettrochimici S.p.A., Milan, Italy

[21] Appl. No.: 862,674

[22] Filed: Dec. 21, 1977

[30] Foreign Application Priority Data

Jul. 1, 1977 [IT] Italy ..... 25326 A/77

[51] Int. Cl.[2] ..... C25B 11/03; C25B 11/10; C25B 9/04

[52] U.S. Cl. ..... 204/252; 204/284; 204/288; 204/290 F

[58] Field of Search ..... 204/252, 284, 288, 290 F, 204/263

[56] References Cited

U.S. PATENT DOCUMENTS

| | | | |
|---|---|---|---|
| 3,674,676 | 7/1972 | Fogelman | 204/288 X |
| 3,873,437 | 3/1975 | Pulver | 204/288 X |
| 3,956,097 | 5/1976 | de Nora et al. | 204/252 |
| 4,028,214 | 6/1977 | Ford et al. | 204/252 X |
| 4,033,849 | 7/1977 | Pohto et al. | 204/252 X |
| 4,078,987 | 3/1978 | Specht | 204/252 X |
| 4,108,752 | 8/1978 | Pohto et al. | 204/268 X |
| 4,120,773 | 10/1978 | Ridgway | 204/288 X |

*Primary Examiner*—John H. Mack
*Assistant Examiner*—D. R. Valentine
*Attorney, Agent, or Firm*—Hammond & Littell

[57] ABSTRACT

Describes a monopolar diaphragm electrolytic cell with dimensionally stable anodes in which the anodes rest freely in the cell and are spring-pressed toward the diaphragms by spring-loaded transverse arms on the positive current carriers, which in use contact, but are not mechanically connected to, the anodes, the spring-pressed electrical contacts between the transverse arms and the anodes are sufficient to carry current to the anodes without substantial ohmic drop through these contacts and permit the anodes to be removed from the cells for recoating and other purposes without destroying any welds or other permanent mechanical connections between the anodes and other portions of the cell.

11 Claims, 10 Drawing Figures

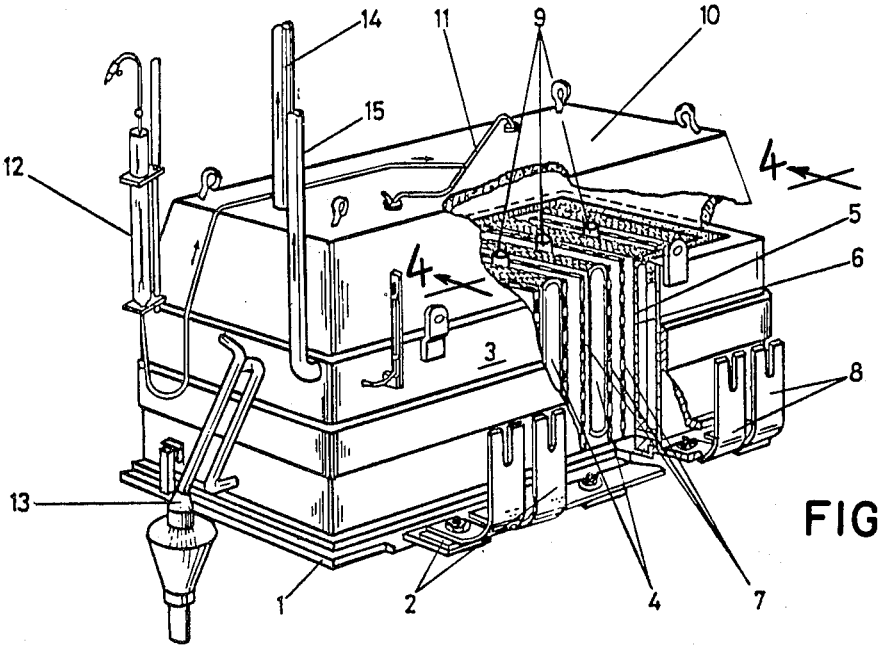
FIG. 1
FIG. 2
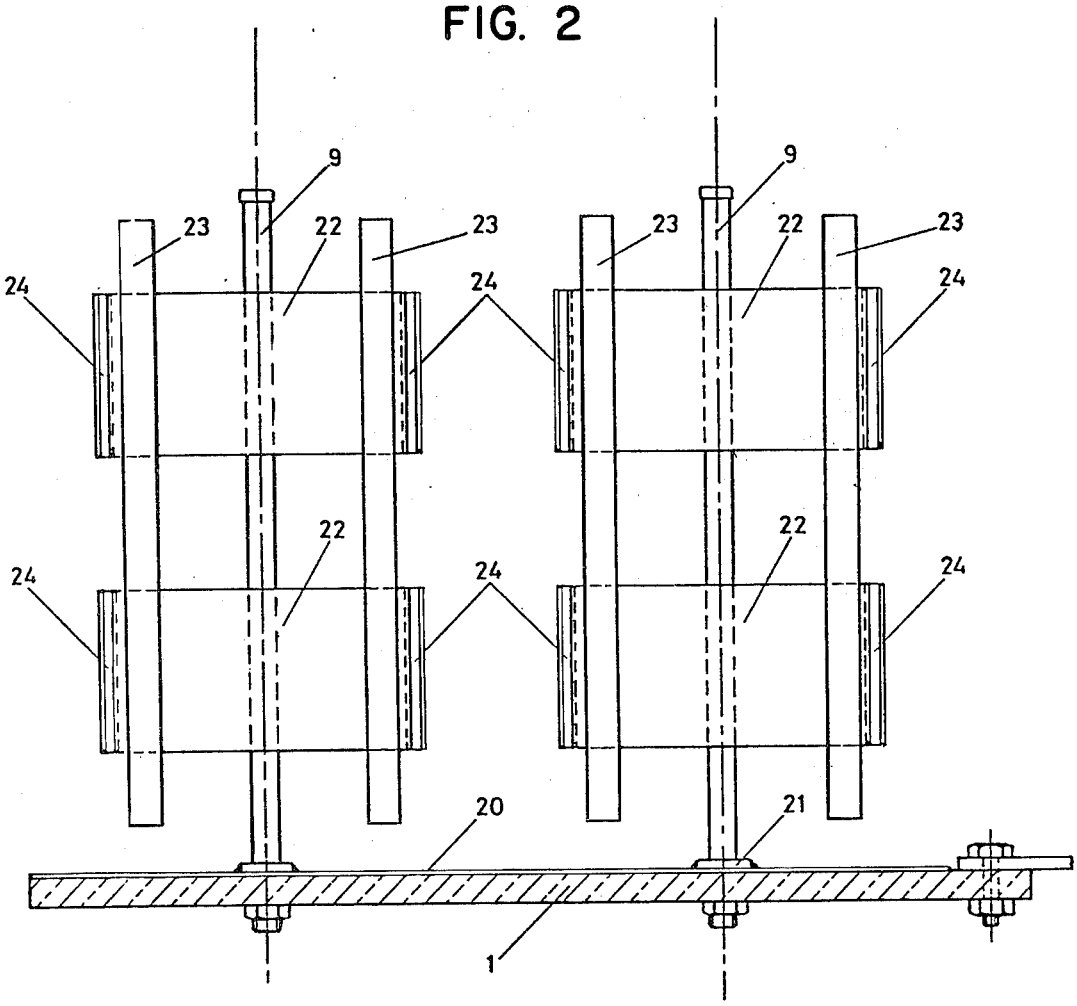

MONOPOLAR ELECTROLYTIC DIAPHRAGM CELLS WITH REMOVABLE AND REPLACEABLE DIMENSIONALLY STABLE ANODES AND METHOD OF INSERTING AND REMOVING SAID ANODES

This invention relates to an electrolytic cell of monopolar type with diaphragm and more particularly, but not exclusively, an electrolytic cell adapted for the electrolysis of halides of alkali metals.

Monopolar cells with diaphragm have been used for decades for the production of halogen and alkali metal hydroxides from aqueous solutions of alkali metal halides. Such known cells are provided with a series of cathodes and anodes positioned opposite each other and separated by a permeable diaphragm, commonly of asbestos fibers, deposited on a cathodic structure of metallic mesh by suction of a suspension of asbestos fibers in liquid medium. More recently, the conventional asbestos diaphragm has been replaced in some instances by cationic membranes substantially not permeable to the electrolyte. The electrolyte, consisting of an aqueous solution of alkali metal halide, is introduced into the anodic compartment, where halogen forms on the anode, while, in the cathodic compartment, evolution of hydrogen occurs at the cathode as well as the formation of alkali metal hydroxide.

With permeable diaphragms, the electrolyte contained in the anodic compartment percolates through the diaphragm into the cathodic compartment by virtue of a pressure differential maintained across the diaphragm and a solution of alkali metal hydroxide containing a percentage of alkali metal halide collects in the cathodic compartment, which solutions are subsequently separated.

With non-percolating cationic membranes, the electrolyte circulates through the anodic compartment, maintaining its concentration almost constant, and the alkali metal ions are selectively transferred across the cationic membrane into the cathodic compartment, where they combine with hydroxyl ions generated at the cathode by electrolysis of the water, to form the alkali metal hydroxide, which in this case is substantially free of alkali-halide.

Cells of this kind and their mode of operation are fully described in U.S. Pat. Nos. 2,987,463, 3,390,072, 3,403,083, 3,591,483, 3,773,634 and 3,859,196, the disclosures of which are incorporated herein.

Such cells are, however, subject to periodic stoppages and disassembly to renew the diaphragm (on the average, every 4 to 12 months) and, if necessary, the electrocatalytic coating on the dimensionally stable titanium anode bases, which are coated with catalytic deposits usually containing oxides of platinum group metals or mixed oxides of platinum group metals and valve metals.

The anodes are usually installed on the current-carrying risers extending upward from the bottom of the cell so that they can easily be removed. The anodic structures are usually mounted on current-carrying risers or busbars of valve metal, such as titanium, or copper coated with titanium, on which the anodes of mesh or expanded sheets of titanium covered by the electrocatalytic deposit are secured by welding. The current-carrying risers or busbars are bolted on the steel or copper cell bottom, which acts as current distribution plate to the anodes mounted on the current-carrying risers. The bare surface of the bottom inside the cell is protected from corrosion by a cover of rubber or other corrosion-resistant material, as illustrated, for example, in U.S. Pat. No. 3,591,463. The mounting of the anodes on the current-carrying risers extending upward from the cell bottom necessitates a large number of joints, which cause weak points at these connections, where interstitial corrosion and occasional leaks of electrolyte occur with consequent corrosion of the bottom and of the risers or busbars to which the anodes are welded.

Recently, expandable anodic structures have been proposed (see U.S. Pats. Nos. 3,674,676 and 3,941,676) consisting of an expander for the two sheets of electrocatalytically coated titanium weld-mounted on the current-carrying risers or busbars, connected to the cell base so that the anodes mounted on the risers, in recessed position, can be expanded, after the cathodic box has been positioned on the base, by an elastic or expansion effect, to cause the anodic mesh to be pushed toward the surfaces of the diaphragm. In another construction the anodes are mounted on a vertical plate, which forms one of the walls of the cell container, by means of two or more risers or busbars, similar to those described above, on which the expanded sheets or mesh constituting the anodes are welded individually. Between the two expandable anode sheets, an eccentric system, operable from the outside of the cell, is used to move the anodes toward the diaphragms on the respective cathodes. Although such systems facilitate the mounting of the cathodes and help to reduce the final electrode spacing, they present considerable disadvantages owing to the fact that the anodes are mounted on the bottom or lateral plate of the cell. When bottom-mounted anodes are used, the cell must have as many holes or joints as there are busbars or risers for the anodes contained in the cell. Considerable ohmic drop occurs in the electric connections between the positive plate on the cell bottom and the risers or busbars of the anodes bolted on the positive plate. When it becomes necessary to renew the electrocatalytic coating of the anodes, the anodic mesh must be detached from the risers or busbars, or from the expanders, and, after it has been recoated, must be welded again to the risers.

One of the objects of this invention is to provide a diaphragm electrolytic cell of a monopolar type provided with current carriers or risers permanently secured to the positive plate on the bottom of the cell and with substantially flat-faced anodes, which flat-faced anodes are not mechanically connected to the risers or any element of the cell.

Another object is to provide an improved diaphragm cell of a monopolar type, for which the normal maintenance steps are facilitated by the fact that the anodes can be removed from the cell without having to disconnect them mechanically from any element of the cell.

Another object is to provide improved anodes for diaphragm electrolytic cells of the monopolar type, consisting essentially of substantially flat, perforated or foraminate plates.

Another object is to provide monopolar cells with substantially flat, perforated or foraminate valve metal anode plates which can be removed, recoated and reinstalled in such cells without presenting problems in heating said anodes after each recoating due to ununiform thermal expansion differences among different parts of the anodes.

Various other objects and advantages of the invention will become evident from the following description.

While this invention will be described primarily with reference to the electrolysis of halides of alkali metals, it will be understood that it may be used for other purposes.

The cell of this invention comprises a bottom or positive plate of steel, copper, aluminum or other structural material of high electric conductivity, the inner surface of which, relative to the cell, can be covered by a sheet or blanket of valve metal such as titanium, tantalum, zirconium, hafnium, niobium, or alloys thereof.

From the positive plate, suitably spaced current carriers, busbars or risers, preferably of valve metal or of structural metal of high electric conductivity such as iron, copper or aluminum covered by a valve metal sheath, extend upward to carry current to the anodes.

The current carriers are preferably welded to the positive plate to assure a perfect electric continuity and the cover sheet of valve metal is welded to the current carriers so as to assure a continuous surface of valve metal between the cover sheet and the current carriers or risers which is resistant to the electrolyte and the products of the electrolysis.

On the current carriers or risers, one or more arms are welded transversely to the axis thereof, consisting of flexible elements of valve metal welded to the current carriers and supplied near their free ends with suitable electrical contact surfaces, preferably covered with noble metal or alloys of noble metals which are resistant to corrosion and are non-passivatable, and which make spring-pressesd contact with the anodes.

The cathodic box or cell can, containing the cathodic structures covered by diaphragms or membranes, rests upon the valve metal-covered cell base. The cathode structure is preferably formed by a series of parallel cathodes, preferably consisting of hollow parallel fingers of steel or nickel mesh, or other suitable cathodic material, completely covered by the diaphragms or membranes, and communicates at the base of these fingers with the diaphragm-covered catholyte and hydrogen recovery chamber formed on the inside of the lateral walls of the cell can or cathode box.

The current carriers, and the transverse arms welded to them, are secured on the bottom so as to be aligned between the cathodes of the cell.

The anodes, formed of flat, expanded or foraminate sheets of valve metal coated with an electrocatalytic coating, are located in the spaces between the cathode fingers and the current carriers or risers (with the transverse arms welded thereto) and are supported freely at their lower edge on the bottom or base of the cell.

When the anodes are positioned between the cathode fingers, the transverse arms welded on the current carriers or risers are forced against the adjacent anodes by the use of expanders or by the rotation of eccentrics or the release of elements for the retention of the elastic arms, so that the contact surfaces of the transverse arms are pressed against the backs of the anodes, the faces of which rest against the surface of the diaphragms or membranes on the cathodes. Suitable spacers are preferably placed on the surface of the diaphragms or membranes to maintain a minimum spacing between the active anode surfaces and the diaphragms or membranes on the cathodes.

The electric current is distributed to the anodes through a series of spring-held contacts between the contact surfaces of the arms welded to the current carriers and the back surfaces of the flat anodes (i.e., the surfaces of the anodes not against the diaphragms or membranes).

The cell is closed by a cover, which is usually provided with means for introducing brine into the cell and for recovery of the halogen.

We have found that, although current is fed to the anodes by means of spring-pressed contacts, this is sufficient to provide adequate connection and avoid substantial ohmic drop in the contacts. The movable contacts need carry only a limited current load, as the current is distributed through several contact points extending from top to bottom of the anodes.

The cell of this invention offers considerable advantages over the known cells, as the bottom, provided with the series of current carriers or risers welded or otherwise permanently secured thereto and covered with a sheet of valve metal welded to the base of each current carrier, does not have any joints and therefore is effectively protected against crevice corrosion or any other corrosion. The entire cell bottom, containing the positive plate of the cell and the plurality of current carriers mounted thereon, is an integral structure which requires substantially no maintenance. The removal and reinsertion of the anodes in the cell is an extremely easy and direct operation, which can be carried out without removing or destroying any mechanical or welded connections.

The flat expanded mesh anodes of valve metal can be removed and reactivated outside the cell, by renewal of the electrocatalytic coating, without having to cut the mesh or expanded sheets from the respective current carriers or risers, whereas with the known anodic structures, it is necessary to cut them from the risers, as the electrocatalytic coating is applied to the reticulated anode sheets by heating procedures, which would damage the current carrier (see U.S. Pat. No. 3,940,328) welded to the anodic mesh as in the prior constructions. Also, disassembly of the cell to remove and reinstall the diaphargm on the cathodes is greatly facilitated, as the anodes can be removed from the cell to permit removal and reinsertion of the cathodic box and cathodes without hindrance or interference by the anodes.

The following drawings and detailed description show several embodiments of the invention, but the invention is not limited to these specific embodiments, as other embodiments and improvements on the embodiments shown may be made within the scope of the claims attached hereto.

FIG. 1 is a perspective view, partially broken away, of one embodiment of a monopolar cell with diaphragm according to this invention.

FIG. 2 is a symbolic view adjacent one end of the bottom of the cell of FIG. 1 with integral current carriers or risers secured on the bottom.

Figure 3:
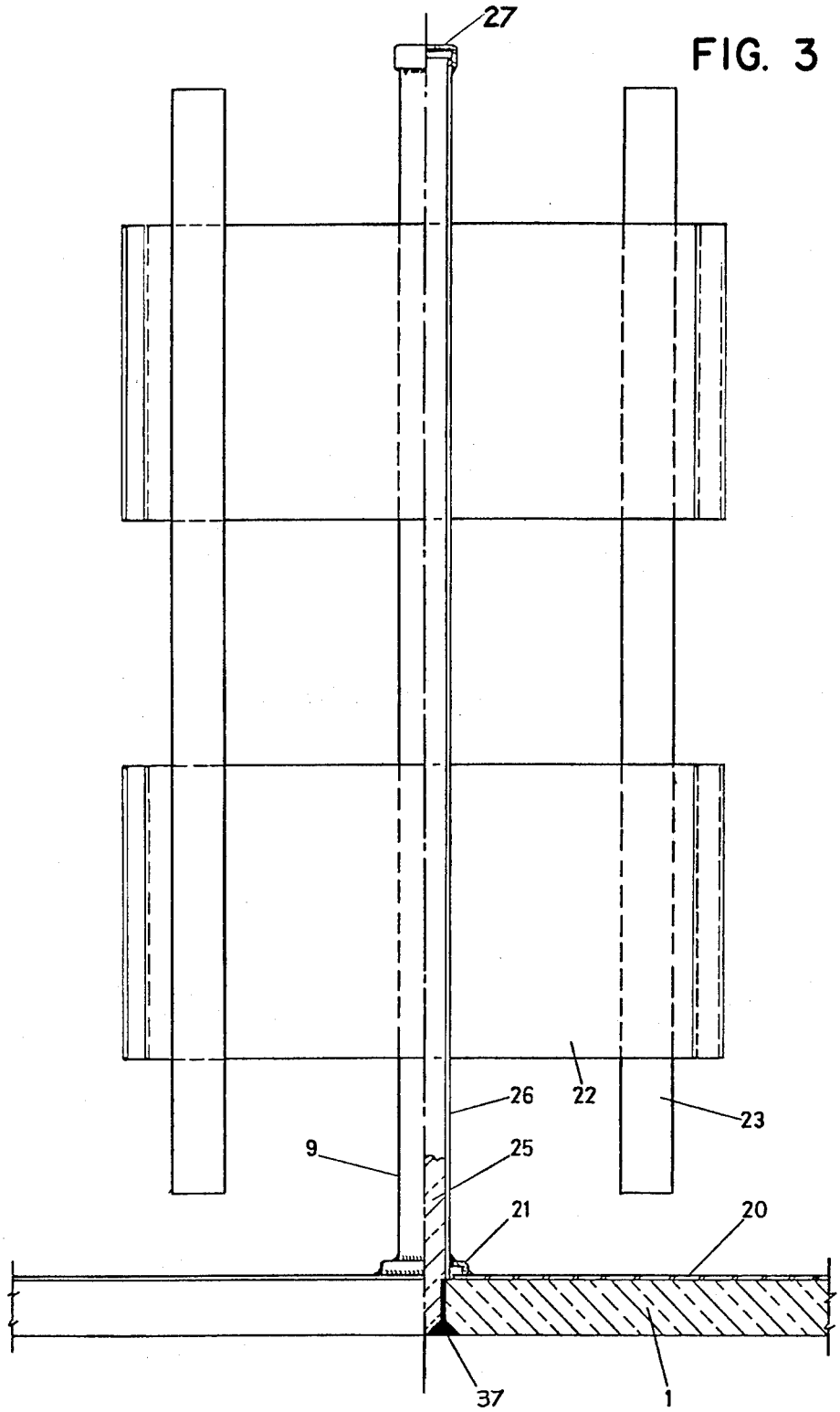
FIG. 3 is a view in elevation, partially in section, of a current carrier secured on the bottom of the cell.

The cell illustrated in FIG. 1 comprises a bottom 1 of steel, copper or other structural metal. The inner surface of the bottom 1 is lined with a titanium or other valve metal sheet 20 (FIG. 2). The bottom 1 constitutes the positive plate for distribution of current to the anodes of the cell and is connected by terminals 2 to the positive bars of the power distribution network. The cathodic box or cell can, preferably of steel, generically indicated by 3, rests on the bottom. An insulating gasket electrically insulates the bottom of the cathodic box 3 from the cell bottom 1 and provides a hydraulic seal between the cathodic box and the cell bottom.

The cathodic box contains a mesh lining of low-carbon steel and includes a series of parallel tubular cathodes or fingers 4 welded at both ends to the side network 5, which is welded all around to the inner surface of the cathodic box or can 3, at a distance from the inner surface of said box so as to provide a space 6, which, together with the space inside the various tubular cathodes 4, constitutes the cathodic compartment of the cell. The cathode box or cell can 3 is connected by means of the terminals 8 to the negative bars of the power distribution network.

On the cathodes 4 and on the network sides 5 of the cathodic box, the diaphragm, typically of asbestos fiber, is deposited by the known techniques, which essentially consist of sucking a suspension of asbestos fibers through the meshes of the network constituting the tubular cathodes 4 and side wall 5, to deposit the asbestos on this network.

From the bottom 1 of the cell, the current carriers or risers 9 extend upwardly between the rows of cathode fingers 4.

The current carriers 9 are welded to the conductive bottom 1 of the cell so as to assure a minimum ohmic drop in this area and the titanium sheath around the core of the current carriers or risers is welded to the titanium sheet 20 which covers the inner surface of the bottom of the cell.

The current carriers or risers 9 are provided with at least two transverse arms of titanium welded on the current carrier itself along two opposite sides thereof, as described and represented in FIGS. 2 to 10.

The anodes 7 of the cell consist of expanded sheets or mesh of titanium, coated with an electrocatalytic coating preferably containing oxides of metals of the platinum group together with oxides of the valve metals. The anodes 7 rest freely on the titanium sheet 20 at the bottom of the cell and are pressed toward the surfaces of the tubular cathodes, which are covered with diaphragms, by the action of the transverse arms welded on the current carriers 9, which arms are preferably spread apart by the use of expanders. The transverse arms 22 are provided with two or more contacts 23 preferably extending over the entire height of the anodes. These contacts press against the inner surface of the anodes and distribute the electric current to said anodes. The cell is completed by a cover 10, preferably of non-conductive plastic material, which rests on the upper flange of the cathodic box 3.

The cell is filled with electrolyte (for example, concentrated sodium chloride brine) so that the electrode structures are completely immersed, and the level is maintained by adding electrolyte through the distributor 11 connected to a level indicator 12.

The electrolyte percolates through the diaphragm and collects in the cathodic compartment, from which it is discharged together with the sodium hydroxide formed, through the outlet 13. The position of the electrolyte outlet is adjustable so as to create and regulate the difference of hydraulic pressure through the diaphragm necessary to maintain the desired flow of electrolyte through said diaphragm.

The chlorine evolved on the anodes collects in the upper space of the cover 10 above the electrolyte gas and flows through the outlet 14 to the chlorine recovery system, and the hydrogen evolved on the cathodes collects in the upper part of the cathodic compartment and flows though the outlet 15.

The bottom 1 of the cell, of conductive metal (preferably copper or iron), is covered with a sheet 20 of titanium (FIG. 2). The current carriers or risers 9 of titanium or titanium-coated metal are permanently secured on the bottom of the cell and the base flanges 21 of titanium risers or current carriers 9 are welded to the titanium sheet 20.

Two transverse arms 22 of titanium are welded on each side of each current carrier 9 and at least two vertical contacts 23 of titanium (preferably platinum-plated on the contact surface) are welded on said two transverse arms 22.

The transverse arms 22 are further provided with guides 24 for the insertion of suitable spreaders or retention elements, not shown.

FIG. 3 illustrates in elevation (partially in section) a current carrier 9, which preferably consists of a copper core 25 and a titanium sheath 26. The copper core 25 is welded directly to the bottom 1 of the cell by the weld 37 and the base flanges 21 of titanium are welded to the titanium sheet 20 which covers the bottom 1. A titanium cover 27, welded to the upper end of the current carrier, completes the protection of the copper core from corrosion.

The transverse arms 22 are formed by titanium sheets, suitably shaped, and are welded in pairs on opposite generatrices of the cylindrical current carrier 9. The contacts 23 are formed by a titanium plate, preferably platinum-plated on the contact surface, welded on the transverse arms 22 (of titanium) or integral therewith and the arms 22 preferably extend from approximately the top to approximately the bottom of the anode sheets 7, which rest loosely on the bottom of the cell.

Figure 4:
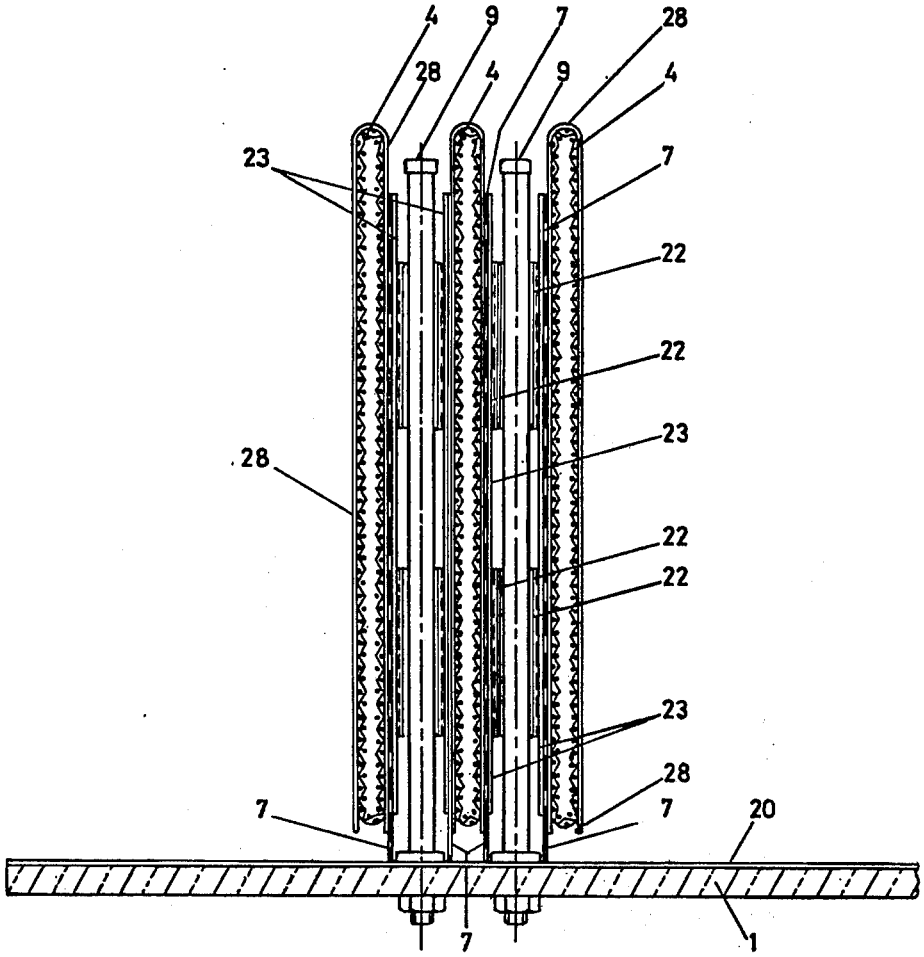
FIG. 4 is a sectional view, substantially on the line 4—4 of FIG. 1, in which three cathodic structures are indicated schematically.

FIG. 4 is a side view, in enlarged section, of a portion of the electrodes of the cell according to the construction illustrated in FIGS. 1 to 3. The tubular cathode fingers 4 of metallic mesh, which are covered by the diaphragm (not shown) and communicate with the diaphragm-covered side network 5, are also shown.

The anodes 7, preferably made of expanded titanium sheets coated with an electrocatalytic deposit, rest freely on the titanium sheet 20 which covers the bottom of the cell and are pressed toward the cathode diaphragms by the transverse arms 22, which are preferably under spring tension. Removable spacers 28 of inert material are interposed between the anodes 7 and the diaphragm to provide the desired spacing of the anodes from the diaphragms. The contacts 23 welded to the transverse arms 22, which, in turn, are welded to the current carriers 9, contact the anodes 7 and carry positive current to the anodes.

Figure 5:
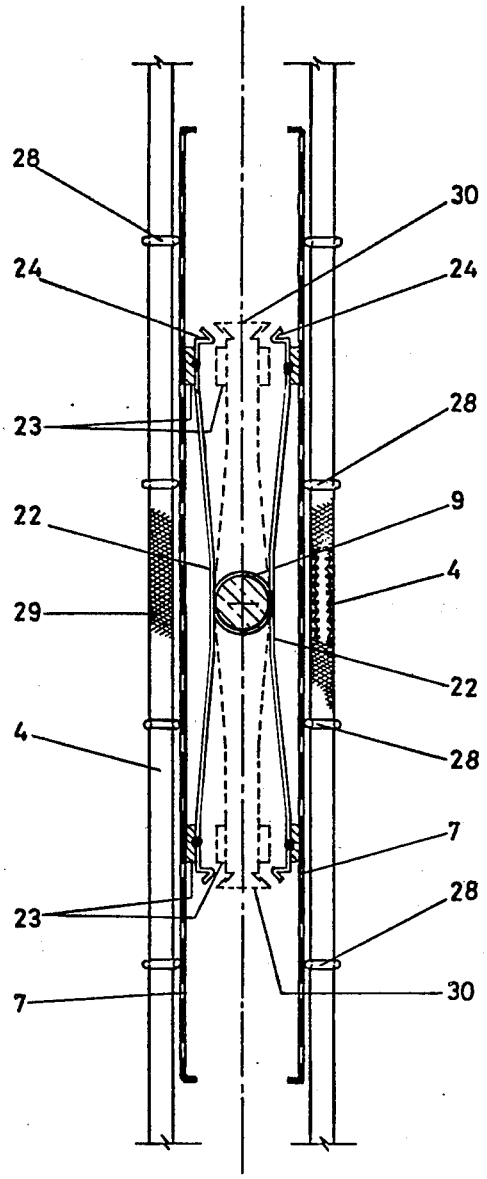
FIGS. 5, 6, 7, 8, 9 and 10 are plan views of some preferred systems for the supply of current to the anodes of the cell illustrated in FIG. 1.

FIG. 5 is a plan view of the electrodes of the cell of FIG. 4. The tubular mesh cathode fingers 4 are covered by the diaphragm 29. Spacers 28 of inert material (for example, teflon), are inserted astride the cathodes to preserve the desired spacing between the anodes and the diaphragms. The transverse arms 22, on which are welded the contacts 23 (which are preferably formed of platinum group metal-plated titanium), are welded on the current carriers or risers 9. During the mounting of the cell, the transverse arms 22 are held in retracted position (broken lines in FIGS. 5 to 10) by retention elements 30 of steel or other material. After the anodes 7 have been inserted in the cell, the retention elements 30 are disengaged from the guides 24 provided on the transverse arms 22, preferably by pulling the retention elements upward out of the cell can. The arms 22 then spread owing to their elasticity and, through the contacts 23, press the anodes 7 against the spacers 28, assuring both the perfect positioning of the anodes and the distribution of electric current through the contacts 23 to said anodes.

Figure 6:
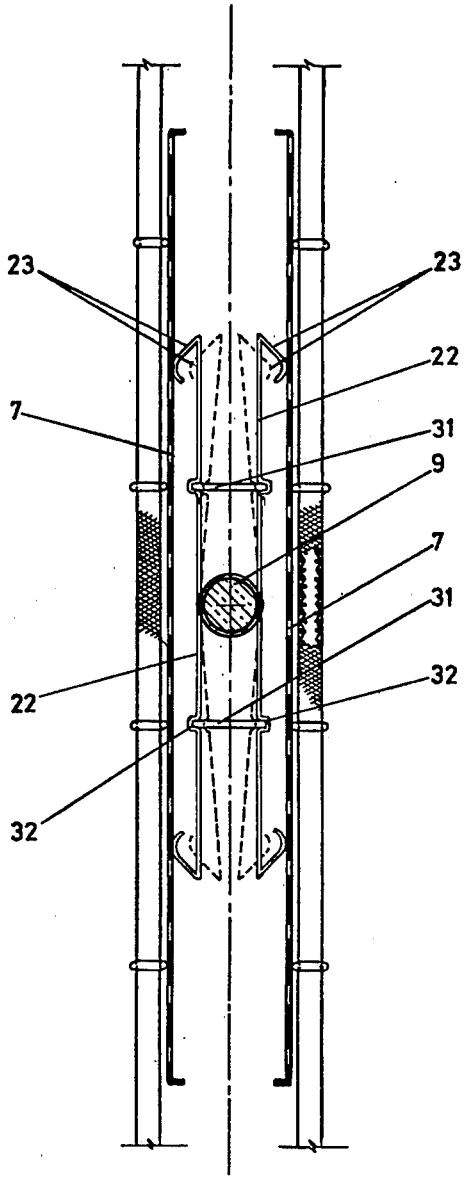

FIG. 6 shows an alternative construction of the power supply system to the anodes of the cell. In this embodiment, the contacts 23 are formed in one piece with the transverse arms 22, which are preferably formed of single sheets of titanium and then welded on the current carriers 9. The contacts 23 are formed by suitably shaping the transverse arms 22 and the surfaces of the contacts 23 are preferably platinum group metal-plated so as to establish good electric contact with the anodes. In this illustration, the retracted position of the transverse arms is indicated in broken lines. After the anodes 7 have been inserted in the cell, the arms 22 are spread apart by the insertion of tapered expanders 31, preferably of titanium, into the guides 32 of the transverse arms.

Figure 7:
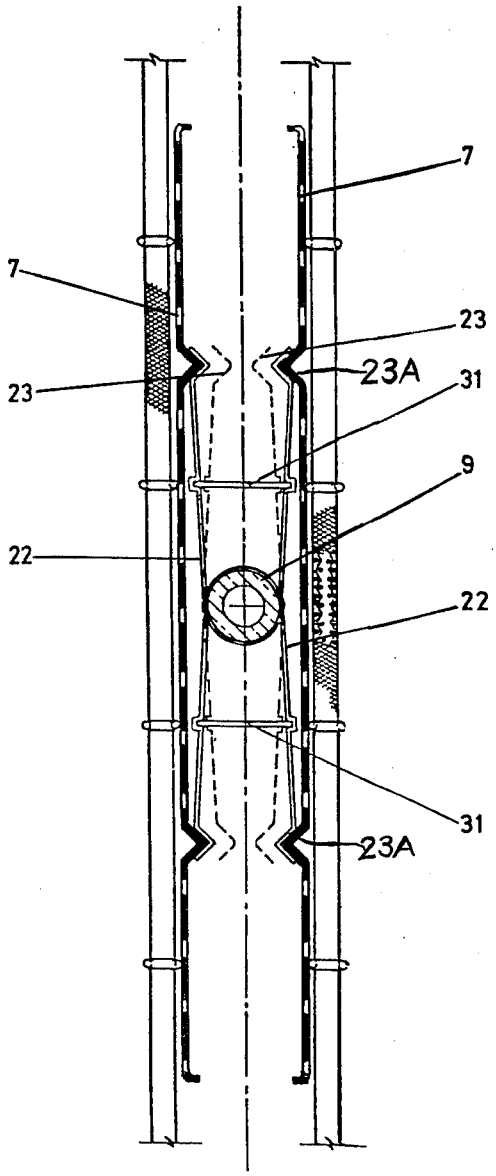

FIG. 7 is a plan view of a further alternative construction of the power supply system to the anodes of the cell, in which the transverse arms 22 are formed by single sheets of titanium welded on the current carriers 9, which consists of a tubular core of copper coated with titanium. The contact surfaces 23 are formed in the transverse arms by bending the titanium sheet along its entire height so as to form a wedge-shaped, concave surface, adapted to match a similar convex surface 23A formed by similarly bending the anodes 7. The contact surfaces 23 and 23A are coated with a deposit of platinum group metal or platinum group metal oxide or other non-passivatable material. The transverse arms 22, illustrated in retracted position by broken lines, are spread apart by the insertion of the wedge-shaped expanders 31, so that, through the surfaces of the contacts 23, the anodes 7 are pressed toward the adjacent tubular cathode diaphragms and current is conveyed to the anodes.

Figure 8:
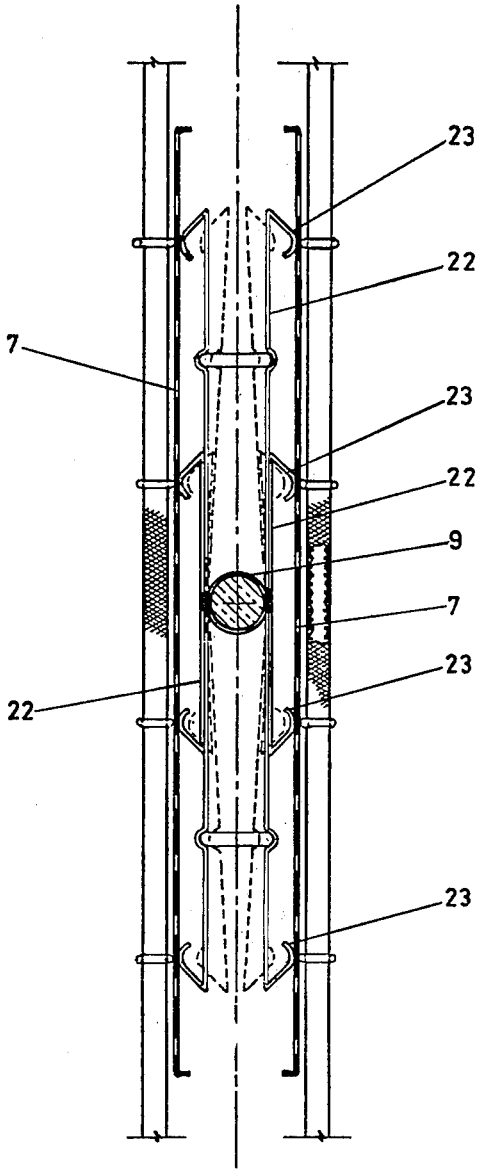

FIG. 8 is a plan view of a further example of how the anodes may be moved toward the cathodes and of the power supply system to the anodes. In this example, the transverse arms 22 welded on the current carriers 9 each carry four vertical contacts 23, which are spaced from each other so as to distribute current to the anodes 7 along four parallel vertical lines rather than along two lines as illustrated in the preceding embodiments. The arms 22 are spread apart by the insertion of wedge-shaped spreaders, similar to spreaders 31 of FIG. 7, into slots provided for that purpose.

Figure 9:
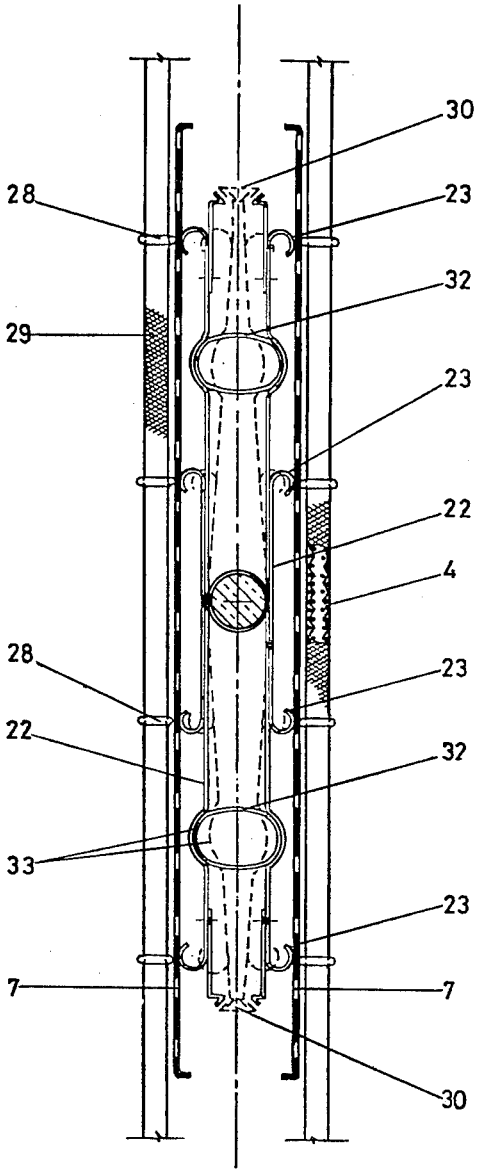

FIG. 9 is a plan view of another construction of the spreader and power supply system to the anodes. As in the preceding embodiment, the transverse arms 22 are provided with four vertical contacts 23, each spaced equally along the arms 22, and are provided with platinum-plated contact areas. The spreading system of the arms 22 consists of two or more tubular elements 32 (preferably of inert material such as titanium or suitable plastic materials), of ovalized cross-section, which are inserted in suitable seats 33 formed by suitably shaping the transverse arms 22. After the anodes 7 are inserted in the cell, the retention elements 30 are slipped off and the tubular elements 32 are rotated in their seats 33 so as to place them with their major axes perpendicular to the anodes 7, thus causing further spreading of the transverse arms 22 and pressure of the contacts 23 against the anodes 7, which bear against suitable spacers 28 placed over the outer surface of the diaphragm 29 which covers the cathode fingers 4.

Figure 10:
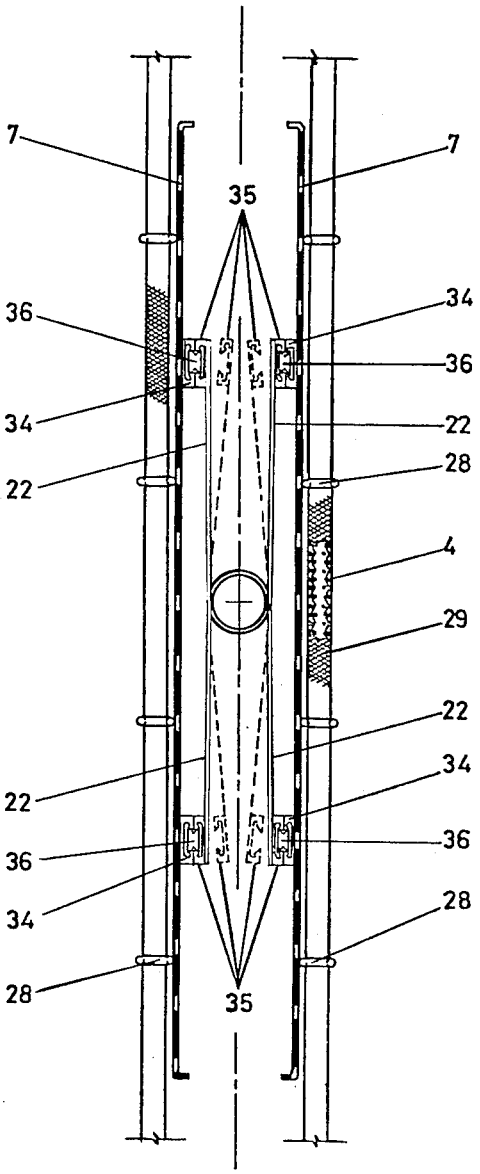

FIG. 10 is a plan view of a less preferred embodiment of the power supply system to the anodes of the cell. In this embodiment, the anodes 7 are provided with at least two titanium additions 34 welded in vertical position on the back of said anodes. These titanium additions 34 are provided with a trapezoidal or equivalently shaped guide and similar vertical titanium additions 35 are welded on the transverse arms 22. Titanium dovetail slides 36 are used to firmly connect the anodes 7 to the transverse arms 22. All coupling surfaces of the guides 34 and of the titanium slides are preferably covered with a deposit of non-passivatable metal, such as, preferably, platinum group metal plate, resistant to corrosion, to assure good electric contact between the anodes and the arms 22. The arms 22, illustrated in retracted position by broken lines in the figures, are spread apart by insertion of spreading elements or by disengaging any retention elements, in which case the transverse arms act by elastic resilience to press the anodes 7 against the spacers 28 placed over the tubular cathode fingers 4 covered by the diaphragm 29. In this figure, the elastic contact between the arms 22 and the anodes 7 is made by insertion of the dovetail slides 36 into the trapezoidal guides of the vertical additions 34 and 35 welded on the anodes 7 and on the ends of the arms 22.

When the anodes of the embodiment of FIG. 10 are to be removed from the cell, the slides 34 are removed by pulling them upward and the arms 22 are compressed toward each other to provide space between the retracted arms 22 and the diaphragms to permit the anodes to be freely withdrawn from the cell, after which the cell can 3, containing the diaphragm-covered, tubular fingers 4, can be readily lifted upward off the cell bottom 1. In the embodiments of FIGS. 5 to 9 inclusive, the spreaders 31, 32, etc., are removed or retracted and the arms 22 are held in retracted position during removal of the anodes from the cell and removal of the cell can from the cell bottom.

It will be understood that at least the contacting areas of the movable contacts and of the matching anodes must be covered with a layer of an electrically conducting material non-passivatable in the anolyte environment. We have found that according to the commercial coating procedures, the foraminous anodes are normally also coated on their back surface (that is, the surface removed from the opposing cathode) with the electrically conductive, catalytic and non-passivatable coating and do not need any other special treatment of the contact areas, whereas the contact area of the movable contacts can be coated, before assembly, with a layer of a platinum group metal or alloy thereof, as well as with a layer of other electrically conducting and non-passivatable material, such as for instance of the same composition as that used to coat the dimensionally stable anodes.

Although the invention has been described with reference to the various examples illustrated, it is understood that such examples do not in any way limit the invention and that numerous modifications are possible while yet remaining within the scope of the invention and that the word "diaphragm" is intended to cover either porous diaphragms or membranes.

We claim:

1. In a monopolar electrolytic cell, a conductive bottom, a cell can, containing spaced, hollow, tubular, diaphragm-covered cathodes, on said cell bottom, a cell top, positive current connections to said bottom, negative current connections to said cell can, spaced current conductors electrically connected to and extending upward from said cell bottom between said cathodes, flexible current-carrying arms on said current-carrying conductors, flat valve metal anodes resting loosely on said cell bottom between said current conductors and said cathodes, spring-held contacts between said flat valve metal anodes and said flexible current-carrying arms whereby current connection can be made and broken between said anodes and said current-carrying arms, and an electrically conducting electrocatalytic coating on said anodes.

2. The cell of claim 1 in which the valve metal anodes are an expanded mesh construction.

3. The cell of claim 1 in which the valve metal anodes are coated with an electrically conducting electrocatalytic coating containing an oxide of a platinum group metal and an oxide of a valve metal.

4. Monopolar electrolytic cell with diaphragm, comprising a bottom, connected to the positive pole of the electric source, to which the anodes of the cell are electrically connected, and a cathodic box, connected to the negative pole of the electric source, to which the cathodes of the cell are connected and which is formed by hollow, tubular, porous structures equidistant from and parallel to each other and covered by diaphragms, characterized in that current carriers extend vertically from the bottom of said cell between the hollow, tubular, porous cathode structures, flexible transverse arms provided with contacts to distribute the electric current are secured on said current carriers, the anodes, of substantially flat, reticulated valve metal, are inserted in the space between said transverse arms and the diaphragm-covered cathode surfaces of the adjacent cathodes, the lower edges of the anodes rest on the bottom of the cell and are held in position against insulating spacers on the diaphragm-covered adjacent cathode surfaces by the force exerted by said contacts on the back of said anodes as a result of the spreading of said flexible transverse arms by elastic effect or through the insertion of spreaders.

5. The cell of claim 4 in which the flexible transverse arms are spread by the elasticity of said arms.

6. The cell of claim 4 in which the flexible transverse arms are spread by spreaders.

7. The cell of claim 4 in which the anodes are formed of expanded sheets of valve metal coated with an electrocatalytic deposit of metals from the platinum group and oxides thereof.

8. The cell of claim 4 in which the anodes are coated with a coating containing platinum group metal oxides and valve metal oxides.

9. The cell of claim 4 in which the contacts on the transverse arms and the anodes have contact surfaces coated with an electrically conductive and non-passivatable deposit comprising a material selected from the group consisting of the platinum group metals, their alloys and their oxides.

10. The method of inserting and removing dimensionally stable, electrocatalytically coated, valve metal anodes into and out of monopolar electrolytic cells having spaced diaphragm-covered cathodes therein and current conductors extending into said cells between said cathodes, which comprises supporting said anodes loosely on the bottom of said cell, providing flexible current-carrying arms on said conductors, with spring-held contacts between said arms and said anodes, providing means to hold said current-carrying arms compressed toward each other during insertion of said anodes in said cells, holding said current-carrying arms compressed together during insertion of said anodes in said cells, inserting said anodes into said cells, releasing said holding means to cause said arms to press the anodes toward the cathodes and make electrical contact between said arms and said anodes, and holding said arms compressed toward each other during removal of said anodes to break said spring-held contacts and provide space for the removal of said anodes.

11. The method of claim 10 in which the current conductors extend upward from the bottom of the cell.

* * * * *